United States Patent [19]

Peytavin

[11] Patent Number: 4,658,617

[45] Date of Patent: Apr. 21, 1987

[54] METHOD PERMITTING THE INCREASE OF OPERATIONS OF COLD PILGER MILLS AND AN APPARATUS FOR THE EMBODIMENT OF THIS METHOD

[75] Inventor: Pierre Peytavin, Neuilly-sur-Seine, France

[73] Assignee: Vallourec, France

[21] Appl. No.: 688,298

[22] Filed: Jan. 2, 1985

[30] Foreign Application Priority Data

Jan. 5, 1984 [FR] France ..... 84 00697

[51] Int. Cl.[4] ..... B21B 45/02

[52] U.S. Cl. ..... 72/44; 72/208; 72/214

[58] Field of Search ..... 72/201, 208, 214, 44, 72/45, 46, 342, 463

[56] References Cited

U.S. PATENT DOCUMENTS

| | | | |
|---|---|---|---|
| 3,813,911 | 6/1974 | Bibighaus | 72/208 |
| 4,184,352 | 1/1980 | Potapou et al. | 72/208 |

FOREIGN PATENT DOCUMENTS

| | | | |
|---|---|---|---|
| 2749102 | 5/1979 | Fed. Rep. of Germany | 72/214 |
| 103203 | 8/1980 | Japan | 72/208 |
| 395128 | 8/1973 | U.S.S.R. | 72/214 |

*Primary Examiner*—Lowell A. Larson

*Attorney, Agent, or Firm*—McDougall, Hersh & Scott

[57] ABSTRACT

The method consists of a cold pilger mill to effect a recoil movement of the chuck upstream followed by a return to its original position, at least once per rolling cycle. The period during which the mandrel is withdrawn with respect to its rolling position is used advantageously for example to carry out the rotation of the mandrel and/or to cause a lubricant under pressure to circulate between the mandrel and the pipe. The method is applied particularly to the rolling of pipes with a large section, with high reduction rates.

5 Claims, 8 Drawing Figures

Figure 1:
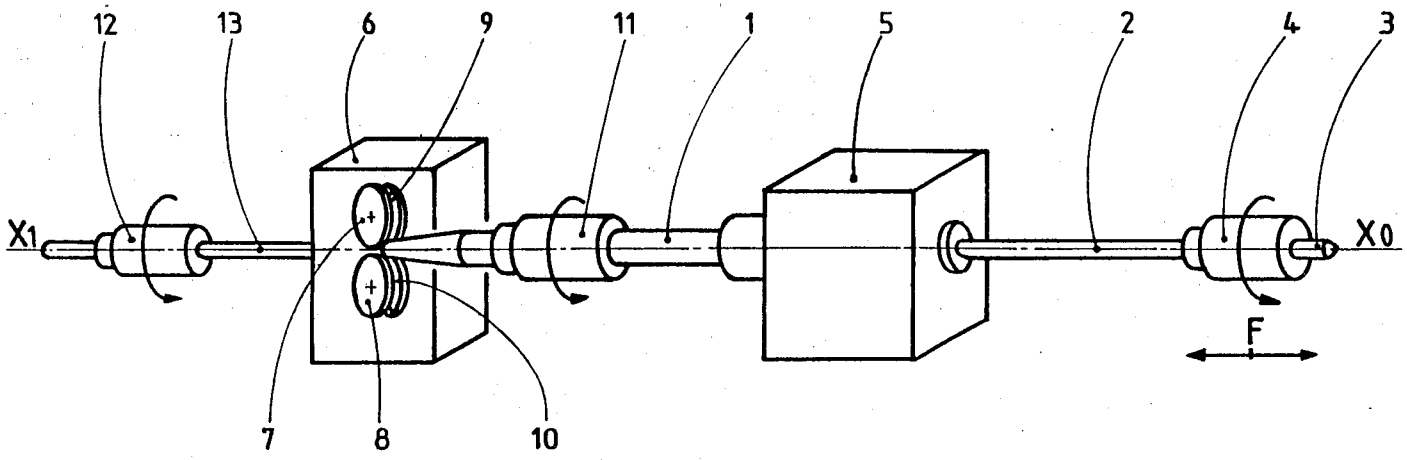

METHOD PERMITTING THE INCREASE OF OPERATIONS OF COLD PILGER MILLS AND AN APPARATUS FOR THE EMBODIMENT OF THIS METHOD

The method and apparatus to which the invention relates relate most generally to the operation of cold pilger mills for the rolling of pipes. More specifically it relates to the pilger mills of this type used for rolling pipes, particularly steel pipes of large diameter with high reduction rates.

As known, such pilger mills comprise grooved rolls mounted in a roll carriage which effects an oscillating movement along the rolling axis. The pipe blank is periodically advanced along the rolling axis in a downstream direction. A mandrel is located inside the blank along the rolling axis and in a fixed axial position in relation thereto.

These pilger mills produce excellent results for the work with pipes of relatively small section. Conversely when it is desired to use them to roll pipes with a large diameter and large section, serious difficulties are encountered. Despite an intensive sprinkling of the outer surface of the pipe blanks, in the rolling zone, it is impossible to avoid considerable heating which is transmitted to the contact zone between the pipe blank and the rolling range of the mandrel. This results in at least a partial destruction of the lubricating film covering the inner surface of the blank resulting in a seizing of the pipe on the mandrel.

This may lead to a rapid destruction of the surface of the mandrel by cracking and the simultaneous appearance of flaws on the inner surface of the rolled pipes.

The possibility has been sought to improve the operating conditions of the cold pilger mills, particularly in the case of the rolling of pipes with large sections, in order to avoid the presence of flaws on the inner surface of the pipes and to extend the lifetime of the mandrels.

The method which is the subject matter of the invention relates to cold pilger mills comprising a mandrel whose rolling range has a decreasing diameter from upstream toward downstream. It consists of effecting, at least once per rolling cycle, corresponding to a round-trip displacement of the rolls carriage, a recoil movement of the mandrel along the rolling axis toward upstream followed by a return movement to its initial position.

This recoil movement followed by a return movement of the mandrel can be effected while the blank is released from the hold of the rolls in the vicinity of the upstream dead center and/or the downstream dead center of the roll carriage.

The recoil of the mandrel also may be effected in the vicinity of one of the two dead centers of the roll carriage and the return may be carried out in the vicinity of the other dead center. In this case no rolling phase of the blank should take place during the period between the recoil and the return of the mandrel.

The recoil amplitude of the mandrel preferably ranges between two and ten times the feed amplitude given the blank before each rolling pass.

It is interesting to utilize the period during which the mandrel is withdrawn with respect to its rolling position, in order to carry out the rotation of the mandrel in coordination with the rotation of the blank. By working in this manner it is possible to avoid the rotation problems of the mandrel and the rotation problems of the blank, while assuring a coordination of both rotations.

Is it particularly advantageous to utilize the period during which the mandrel is withdrawn with respect to its rolling position in order to cause one or several fluids under pressure to circulate successively or simultaneously in the annular space included between the mandrel and the pipe blank. These may be gaseous or liquid fluids, the latter preferably being lubricants. These fluids preferably are injected at a pressure of 2 to 20 relative bars.

The fluid is introduced in a particularly efficient manner into the annular space comprised between the which connects part connecting the mandrel to the mandrel-holding shaft and the blank pipe, upstream from the rolling range of the mandrel and downstream from a first annular tightness means which assures a dynamic tightness between the connecting part and the pipe and forces the fluid to flow downstream between the rolling range of the mandrel and the pipe blank. A second annular tightness means advantageously is positioned downstream from the rolling range, assuring a dynamic tightness between the mandrel and the pipe blank and forcing the fluid(s) to return upstream through a passage provided in the mandrel. These dynamic joints may be of any known type, such as lip joints or toric joints; metallic joints such as segments or toruses with metallic or other jackets also may be used.

The invention also relates to an apparatus allowing the recoil and then the return of the mandrel of a cold pilger mill. This apparatus comprises a known type of a mandel holding rod pincer which seizes said rod in the vicinity of its posterior end so as to maintain it in a fixed position along the rolling axis; said rod pincer is mounted on a fixed support with the aid of a connecting means allowing the rod pincer to slide in a direction parallel with the rolling axis; an alternate entrainment means, controlled by the rolling cycle, causes at certain moments determined by this cycle, the recoil of the rod pincer, then its return to its initial position at the desired amplitude and speed.

The alternate entrainment of the rod pincer is carried out, preferably with the aid of a cam. Between the end of the recoil of the pincer rod and its return to its initial position, it is possible to provide for a holding time in the position of withdrawal.

One advantageous application of the method and apparatus according to the invention relates to the case where it is intended to effect a double feed of the blank to the upstream and downstream dead centers. It then is possible to simultaneously effect, in the vicinity of each of these two dead centers, a movement of withdrawal and then of return of the mandrel which allows for an efficient lubrication and cooling. It then is possible to effect two rolling passes at each cycle.

In order to prevent or limit the upstream sliding of the blank during the return rolling pass, it is possible to connect the already rolled part of the blank, downstream from the roll carriage, to a holding means which holds it in a fixed position with respect to the frame of the rolling mill during at least part of the return run of the roll carriage.

The following detailed description and the figures offer in a non-limitative manner the characteristics of the method and apparatus according to the invention.

FIG. 1: overall view of a cold pilger mill comprising the apparatus according to the invention.

Figure 2:
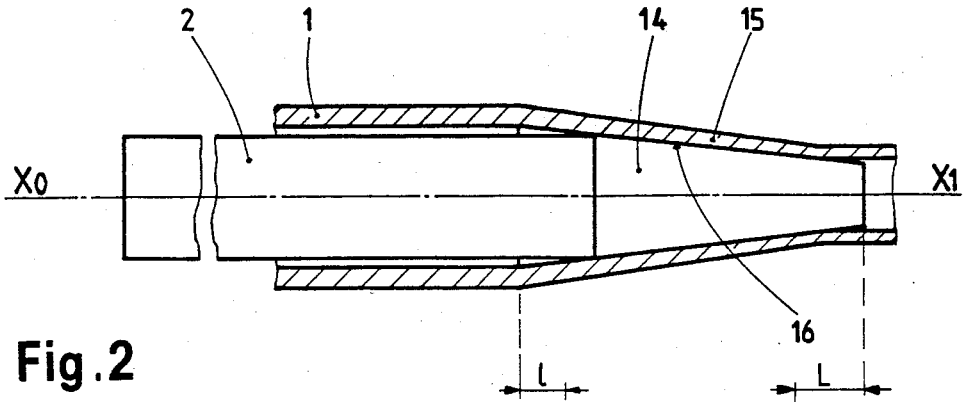
Figure 3:
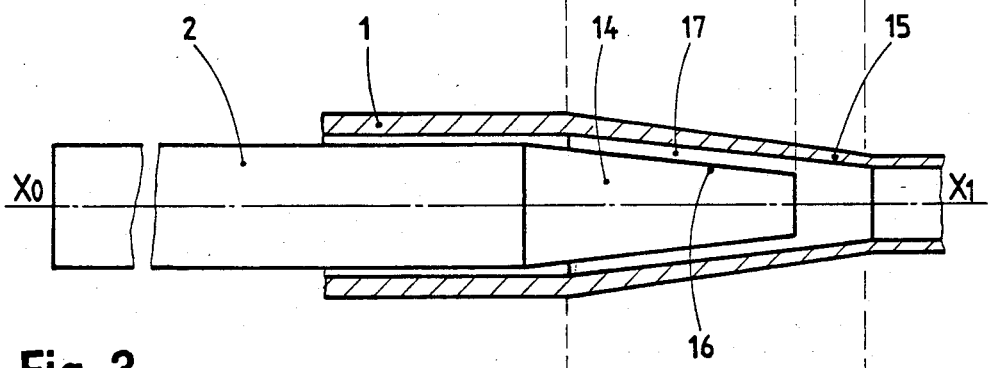
Figure 4:
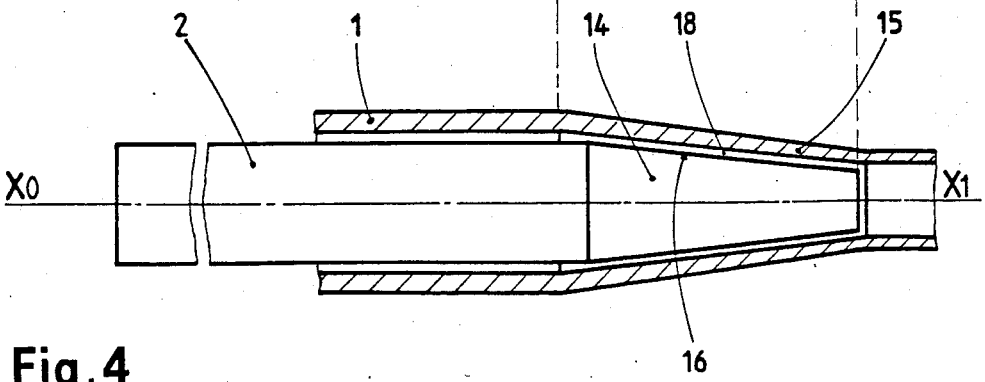

FIGS. 2, 3 and 4: views representing the operation of the method according to the invention in the case of the pilger mill shown in FIG. 1.

Figure 5:
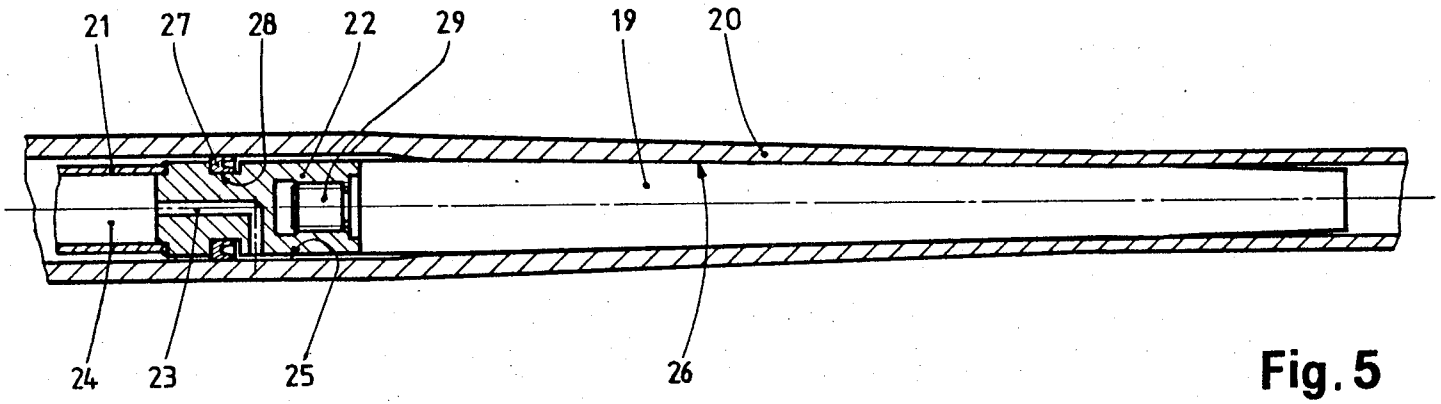

FIG. 5: improved mandrel for the exploitation of the method according to the invention.

Figure 6:
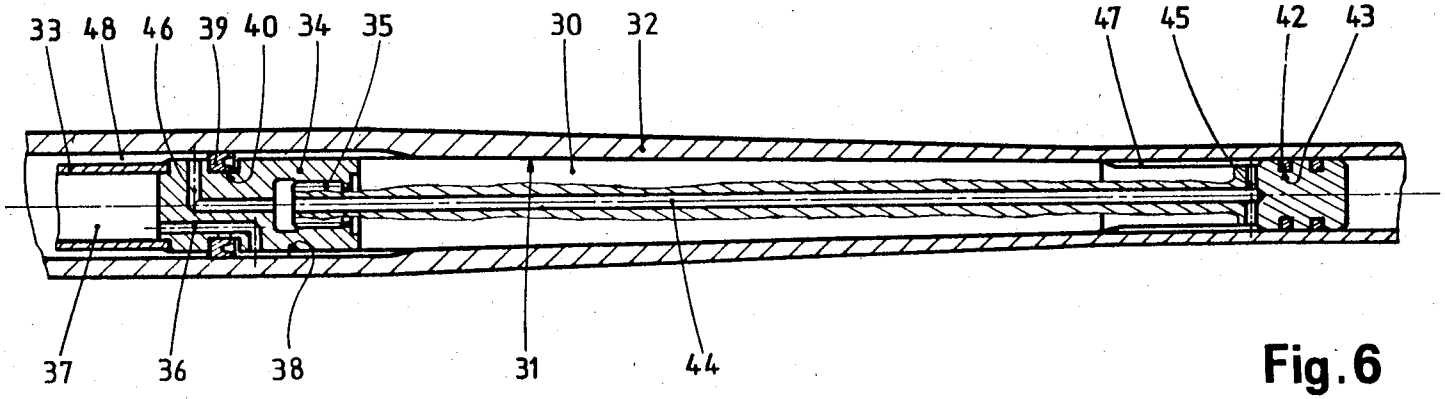

FIG. 6: another improved mandrel for the exploitation of the method according to the invention.

Figure 7:
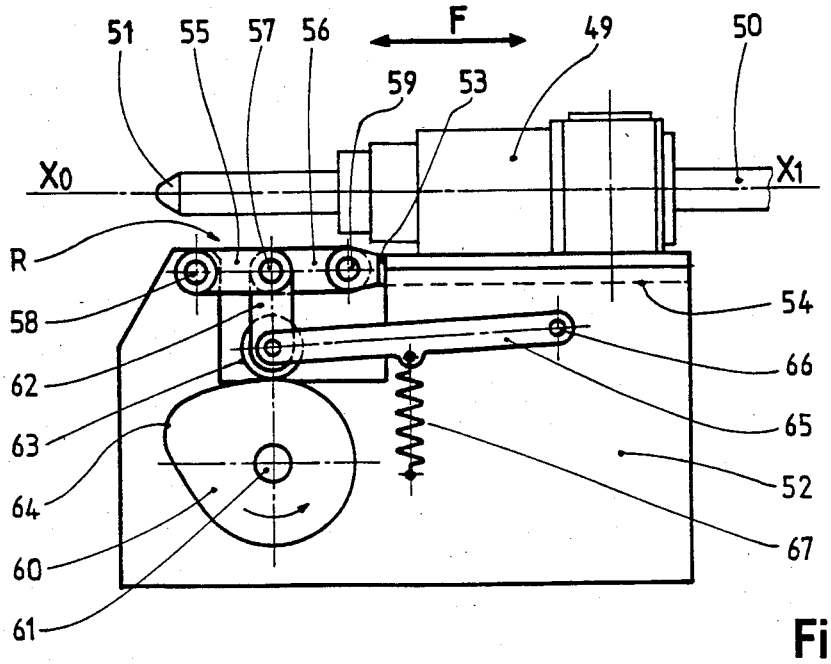
Figure 8:
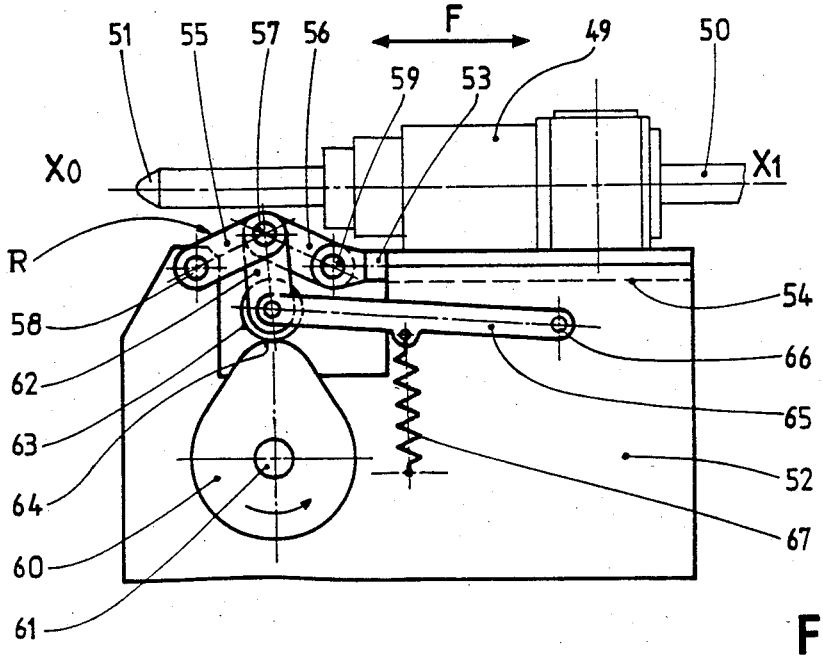

FIGS. 7 and 8: an apparatus for the embodiment of the method according to the invention.

FIG. 1 is a schematic view in perspective of a cold pilger mill operated by the method according to the invention. The pipe blank (1) slides around a mandrel-holding shaft (2) along the rolling axis X0X1. The posterior end (3) of the shaft (2) is maintained by a rod pincer (4) which can put the shaft (2) in rotation around its axis and also displace it alternately along its axis according to the double arrow (F). A thrust means (5) of a known type causes the blank to advance intermittently downstream, at time intervals synchronized with the successive rolling cycles of the roll carriage (6).

Each cycle includes a round trip of the roll carriage along the rolling axis. The rolls (7) and (8) are placed in rotation in either direction. They roll the pipe blank (1) by means of their grooves (9) and (10) which cooperate with the mandrel, not shown in order to lengthen the blank and thin its walls. The pipe pincers cause the blank (1) to rotate upstream in its rolled portion (13) downstream from the roll carriage during the periods when it is released from the grip of the rolls, without impeding the displacements of the pipe along the rolling axis. The rod pincer causes the mandrel holding shaft (2) to rotate in synchronism with the blank (1) and displaces it along the arrow (F) in a manner which will be described in detail.

FIGS. 2, 3 and 4 schematically show the operation of the mandrel used on the rolling mill of FIG. 1.

FIG. 2 shows the mandrel mounted at the end of the mandrel holding shaft (2) in normal rolling position inside the blank (1). The described method comprises one single rolling pass downstream during the go-movement of the roll carriage. FIG. 2 corresponds to the moment where the roll carriage completes its upstream return movement and releases the blank (1) from its grip in the partly rolled zone (15).

As FIG. 3 shows on the one hand a feeding of the blank (1) is carried out and on the other hand the mandrel will be recoiled in the upstream direction, along X0X1, followed by a return to its initial position.

As will be shown, in the case described, these displacements are caused by the intervention of the rod pincer of FIG. 1.

The recoil amplitude "L" is so determined as to create an annular passage (17) of relatively small section between the rolling range (16) of the mandrel and the wall of the pipe in zone (15).

In effect, the only advancing of the amplitude "1" of the pipe blank (1) causes only the formation of a very narrow annular passage, as shown in (18) FIG. 4, following the return of the mandrel to its rolling position. This passage is the more narrow the weaker the actual slope of the rolling range of a mandrel will be than the one figured on these three diagrams. Preferably the recoil amplitude "L" of the mandrel is adjusted to a value ranging from two to 10 times the amplitude "1" of the advance given the blank.

Thus, if necessary, a passage section (17) can be attained that is equal to or greater than the passage section that exists between the blank (1) upstream from the rolling zone and the mandrel in its largest section.

The passage (17) thus opened, even during a very short time, may permit numerous utilizations.

One of the most important of these is the injection of one or several liquid or gaseous fluids simultaneously or successively into the space included between the rolling range (16) of the mandrel and the walls of the pipe in the partially rolled zone (15). As will be seen, it is possible to direct the flow of the fluid(s). Also, in the most frequent case where each round trip cycle of the roll carriage only comprises one rolling pass, most frequently during the go-movement of the roll carriage in the downstream direction it is possible to put the mandrel into the recoil position from the downstream dead center and to so hold it as far as the upstream dead center. Then the circulation of the fluid(s) is permitted during about 50% of the operating time.

FIGS. 5 and 6 describe two types of mandrel which are particularly well adapted to the exploitation of the method according to the invention.

FIG. 5 represents a mandrel inside a pipe blank (20) during the rolling process. A connecting part (22) assembled by a threaded connection (29) to the mandrel, connects it to the hollow mandrel holding shaft (21). A passage (23) puts in communication the inside (24) of the shaft (21) with the annular space (25) included between part (22) and the pipe blank (20) upstream from the rolling range (26) of the mandrel. A first annular sealing means is constituted by a dynamic lip joint (27) placed into a groove (28) formed around the connecting part (22). It is thus possible, by causing a fluid under pressure to arrive via the interior (24) of the shaft (21) to cause it to pass via (23) into the annular space (25) from which it flows downstream, between the rolling range (26) of the mandrel and the pipe blank (20), each time when the recoil of the mandrel clears the passage. The lip joint may be replaced by another type of joint such as a toroidal joint. It also is possible to use a metallic joint such as a segment. Moreover, the assembly between the connecting part (22) and the mandrel (19) can be effected by any means such as welding, brazing or others. These two parts also may be constructed in one single monoblock assembly; likewise the junction between the connecting part (22) and the mandrel holding shaft (21) may be accomplished by any conventional and suitable means like screws, welding, brazing or others.

A second type of mandrel is represented in FIG. 6. Like the one in FIG. 5 it includes a rolling range (31). It is positioned on the inside of a pipe blank (32) which is being rolled. A connecting part (34) is connected on the one hand to the mandrel by the threaded junction (35) and on the other hand to the hollow mandrel holder shaft (33).

A first passage means (36) connects the interior (37) of the shaft (33) with the annular space (38) included between the connecting part (34) and the pipe blank (32) upstream from the rolling range (31).

This space is closed upstream by the dynamic lip joint (39) placed in the groove (40).

Downstream from the rolling range (31) a second annular tightness means is constituted by the dynamic joint (42) located in the groove (43). This joint, analogous in design with the ones described above advantageously is metallic, for example in segment form. It may include several successive elements; this also may be the case for the first tightness means.

A second passage means, constituted by the radial channels (45) and (46) and the longitudinal channel (44) connects the annular space (47) upstream from the joint (42) with the annular space (48) upstream from the joint (39). Thus, with each recoil of the mandrel, one or several fluids can be caused to circulate under pressure, arriving from the hollow shaft in (37) via the passage (36) then into the annular space (38) and subsequently between the rolling range (31) and the blank (32) moving downstream. This fluid or these fluids then return upstream through the channels (45), (44) and (46) and through the annular space (48). The circulation of this fluid or of these fluids also could be organized in the opposite direction.

The method according to the invention is applied by way of an example by using this manner of lubrication and this type of mandrel shown in FIG. 5. Under these conditions steel pipe blanks type AISI 321 are rolled, which have an outer diameter of 133 mm and a thickness of 20 mm. The speed is 120 rolling cycles per minute with one single rolling pass and one single feed per cycle. The pipe obtained with an outer diameter of 88.9 mm is 13.4 mm thick. Near the upstream dead center of each cycle, the blank is advanced by 9.4 mm and the mandrel recoils at 30 mm with return to its initial position. A lubricant of a known type is injected into the space (25) under an approximate pressure of 10 relative bars.

This lubricant circulates, in the manner which was just described, around the rolling range (26) of the mandrel at each recoil of this mandrel. That way rolled pipes are obtained at an approximate speed of 150 meters per hour. It is noted that the surface condition of the inner wall of these pipes is excellent.

The invention also relates to an apparatus which makes it possible to carry out in a simple manner to recoil and then the return movements of the mandrel, synchronized with the round trip cycles of the roll carriage.

FIGS. 7 and 8 schematically show an embodiment of a shaft pincer with a function like the one shown in (4) FIG. 1.

The shaft pincer locks a mandrel holding shaft (50) in the vicinity of its upstream end (51). It maintains the shaft (50) in fixed position along the axis $X_0X_1$ during the rolling passes. It also causes the shaft to rotate about its axis by a fraction of a revolution as previously described.

This shaft pincer is mounted on a fixed support (52) by means of a base plate (53) sliding in a slide (54) parallel with the axis $X_0X_1$ as shown by the double arrow (F).

The sliding of the shaft pincer (49) is controlled by a holding part (R), arranged in the extension of the slide. This part is constituted by two similar elongated rigid members (55) and (56), arranged end to end and articulated with respect to each other about the axis. The free end of the member (55) is articulated about the axis mounted on the fixed part (52).

The free end of the element (56) is articulated about the axis, which is mounted at the front end of the base plate (53). The axes are parallel with each other and perpendicular to the plan of the figure. A cam (60) rotates about an axis (61), which is parallel with the preceding ones.

Said cam actuates the tappet (62) with the aid of a roller (63). This target is articulated about the axis thus making it possible to space this axis from the straight line which joints the axes. The distance between the axes then is reduced and the shaft pincer is shifted upstream thus entraining the mandrel holding shaft (50) and thereby the mandrel secured to its downstream end.

By applying to the bossing (64) of the cam (60) the desired profile, and by operating the cam (60) at a speed which is determined strictly with respect to the movements of the roll carriage, the upstream recoil of the mandrel and then its return to its initial position are realized at the desired moments, with the desired amplitude and at a strictly determined interval of time.

The roller (63) is maintained bearing down on the cam (60) by the arm (65), which is articulated about the axis (66) and pulled by the recoil spring (67). Numerous changes or variations of this apparatus can be realized without exceeding the scope of the invention.

Likewise, the method according to the invention may comprise very numerous modifications which do not either extend beyond the scope of the invention.

I claim:

1. An improved method for cold rolling a pipe blank on a pilger mill, the pilger mill comprising grooved rolls mounted on a rolls carriage to work the blank along the rolling axis between an upstream dead center and a downstream dead center, the pipe blank having a mandrel with decreasing diameter from upstream to downstream located therein, the method comprising the steps of:

working the blank on the grooved rolls between the upstream dead center and downstream dead center;

periodically advancing the blank downstream a set distance;

periodically recoiling the mandrel upstream a distance greater than the distance the blank is periodically advanced downstream and returning the mandrel to its initial position to momentarily increase or create and reduce in size an annular passage; and injecting a fluid in the annular passage.

2. The method of claim 1 wherein the blank is advanced once per set of downstream and upstream movements.

3. The method of claim 1 wherein the mandrel is recoiled when the rolls carriage is near a dead center.

4. The method of claim 1 wherein the mandrel is recoiled about simultaneously to the downstream advancement of the blank.

5. The method of claim 1 wherein the recoil distance is about 2 to 10 times the set distance.

* * * * *